US006209285B1

(12) United States Patent
Patelli et al.

(10) Patent No.: US 6,209,285 B1
(45) Date of Patent: Apr. 3, 2001

(54) AUTOMATIC DEVICE FOR COLLECTION AND PACKING IN A CONTAINER, OF THE STRIP PRODUCED BY A CARDING UNIT

(75) Inventors: Silvano Patelli; Giovanni Battista Pasini; Giovanni Bellotti, all of Palazzolo Sull'oglio (IT)

(73) Assignee: Marzoli S.p.A., Palazzolo Sull'oglio (IT)

( * ) Notice: Subject to any disclaimer, the term of this patent is extended or adjusted under 35 U.S.C. 154(b) by 0 days.

(21) Appl. No.: 09/339,692

(22) Filed: Jun. 24, 1999

(30) Foreign Application Priority Data

Jun. 26, 1998 (IT) ..... MI98A1475

(51) Int. Cl.[7] ..... B65B 63/04
(52) U.S. Cl. ..... 53/116; 19/159 A; 57/281
(58) Field of Search ..... 53/116, 118; 19/159 R, 19/159 A; 57/281

(56) References Cited

U.S. PATENT DOCUMENTS 3,221,374 * 12/1965 Fornes .
3,249,968 * 5/1966 Whitehurst .
3,323,178 * 6/1967 Gossett et al. .
3,407,447 * 10/1968 Kinsler .
3,429,009 * 2/1969 Goodner .
3,729,776 * 5/1973 Johns .
3,808,641 * 5/1974 Schneider et al. .
3,871,087 * 3/1975 Savageau et al. .
4,292,712 * 10/1981 Bonner .
4,709,452 * 12/1987 Cooley et al. .
5,311,645 * 5/1994 Schwalm et al. .
5,339,615 * 8/1994 Hauner .
5,815,888 * 10/1998 Temburg .

FOREIGN PATENT DOCUMENTS 34 07 134 8/1985 (DE) .
197 20 829 1/1998 (DE) .
0 531 754 3/1993 (EP) .
1386573 * 3/1975 (GB) .
1436857 * 5/1976 (GB) .
2041016 * 9/1980 (GB) .
2048321 * 12/1980 (GB) .
168154 * 7/1965 (RU) .
229266 * 2/1973 (RU) .

* cited by examiner

*Primary Examiner*—John Sipos
(74) *Attorney, Agent, or Firm*—Oblon, Spivak, McClelland, Maier & Neustadt, P.C.

(57) ABSTRACT

Automatic device for packing in a container, of the strip provided by a carding unit, consisting of an eccentric distributor which rotates relative to the collection container, which is rotated by an underlying rotary platform, and also comprises a device for movement and centring of the collection containers.

19 Claims, 5 Drawing Sheets

AUTOMATIC DEVICE FOR COLLECTION AND PACKING IN A CONTAINER, OF THE STRIP PRODUCED BY A CARDING UNIT

BACKGROUND OF THE INVENTION

Field of the Invention

The present invention relates to carders, in which a thin layer of fibrous material is processed by a series of carding surfaces, which are provided with coverings with tips, and are set in motion relative to one another, in which the flock fibres are opened, in order to produce separated, stretched fibre strips. In this operation, the impurities and dirt are eliminated, the fibres are mixed with one another, and a fibre strip with a regular yarn count is obtained, which is collected in large containers, to be sent to the successive processing stages.

In particular, the subject of the present invention is the operation of packing in the collection container, the strip produced by a carding unit, or by a drawing frame.

In the known art, devices are described for collection of the strip produced by a carder, for example in the German patent in the name of Rieter, no. 1,510,339, and in the Italian patent application MI95A02123 in the name of the same applicant. In these devices, the exchange of the strip end, when the full container is replaced by an empty container, with corresponding gripping and cutting of the strip section to be joined, is complex and unreliable; inter alia it takes place with both containers at a standstill.

In order to make apparent the technical problems which are involved in this operation, and to eliminate them by means of the present invention, the assembly of the carding unit and the collection unit are described briefly with reference to the drawing in FIG. 1. In the carding unit 1, the fibres, which are separated and mixed in the carding operation, are matted into a web, which has a consistency which is sufficient to be drawn through a condenser by a calender unit 2, which is also known as the drawing unit. This strip is supplied to the collection unit 3, which draws it by means of two calenders (not shown in the figure), from the carding unit, and packs it in the containers 4, by means of a rotary distributor plate, which places the strip in the container itself, in superimposed coils. This rotary distributor 5 is eccentric relative to the container 4 being filled, which is disposed beneath the collection unit 3.

The distributor 5 consists of a horizontal plate, which is driven with rotary motion around its own centre, according to the arrow B, at a speed of approximately hundreds of revolutions per minute.

In turn, the underlying container 4, which is being filled, has a cylindrical shape, and is disposed coaxially on a rotary platform 6, which in turn is driven with rotary motion around its own vertical axis according to the arrow C, at a speed of approximately tens of revolutions per minute, thus distributing the strip in the container, according to coils, the centre of which is translated according to coaxial circles, relative to the platform 6 and the container 4 which is being filled, with an accumulation which increases progressively in thickness but not in level, owing to the effect of the progressive compression of the spring which is beneath the base of the container 4.

The collection of the strip in containers, so that it can be sent to the subsequent processing operations, makes the carding operations independent from the subsequent operations.

At the output of the calenders 2 of the carder 1, along the path of the strip 7 according to the arrow A, towards the collection unit 3, and in particular at the guide pulleys 8*a,b,c* of the latter, according to the known art there is provided a thread-sensor device, which detects whether the strip is present or absent, i.e. whether it is continuous or broken, and in the latter case, the device stops the carder/collection assembly.

The strip which is produced during the carding has limited tensile strength, and must be suitably processed: for this purpose, packing the strip in a container, in superimposed coils, allows it to be extracted subsequently, without generating tensions which the limited strength of the strip cannot withstand. It is also known from the state of the art, for example from patent application MI95A02123 in the name of the same applicant, that for this reason the container for collection of the strip is provided with a mobile base 9, which is thrust upwards by a spring 10, or by an equivalent element, which allows the base 9 to descend as the depositing of the coils of strip onto its surface progresses; this depositing compresses the spring 10, with a range which is limited by an upper end-of-travel projection for the plate 9, and a lower support projection for the spring 10. By this means, the free section of strip, from the distributor element, to the level at which it is deposited in the depositing operation, as well as from the collection element, to the level from which it is collected in the successive operation, in which the strip in the container is supplied to a successive processing operation, remains quite short, and an effect of undesirable drawing of the strip is substantially prevented.

The present invention relates more specifically to the operation of replacement of the containers, and to control and transfer of the end of the strip, from the full container to the empty container, which replaces it in sequence.

According to the known art, this operation is commonly carried out manually by the operators, who, when the pre-determined length required for filling of the container 4 has been reached, replace the full container by the new container, beneath the rotary distribution unit, and cut off the strip deposited in the full container, placing the end on the base of the new container. The mobile base 9 of the container is usually provided with needles or projections to engage and hold the end, and thus to start the new depositing of coils in the new container.

In the aforementioned patent application in the name of the same applicant, there is described a recent automatic container-changing device, in which, however, changing the container makes it necessary to change the speed of the machine, and to slow down or stop production of the machine for the change, with two transitory speeds at the beginning and end of the operation.

These methods for changing and moving the container are not altogether satisfactory, particularly in high-productivity carding units, which process 200 to 400 m of strip per minute.

SUMMARY OF THE INVENTION

DESCRIPTION OF THE PREFERRED EMBODIMENTS

Figure 1:
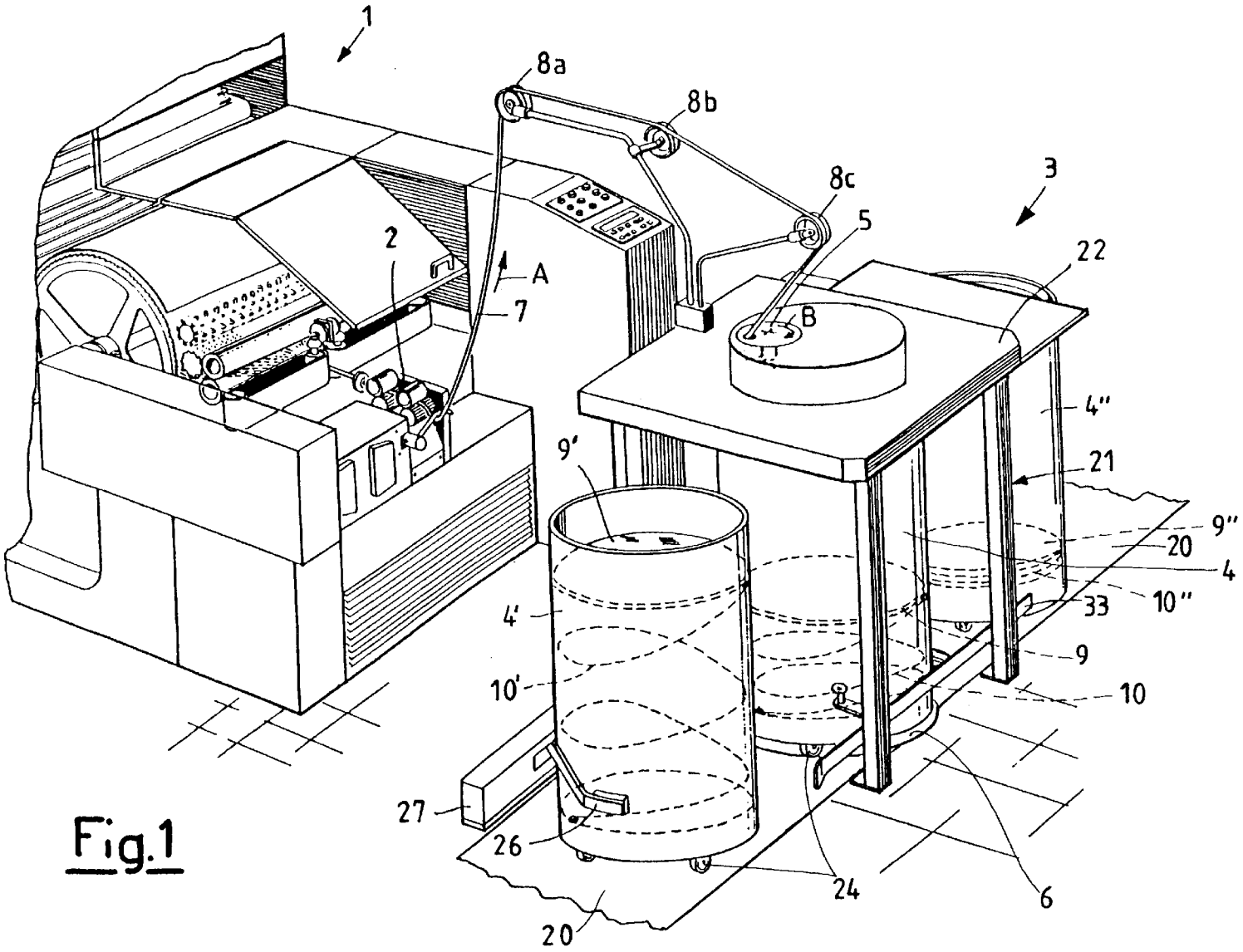
FIG. 1 is a plan view of showing the carding unit and other collection unit.
Figure 2:
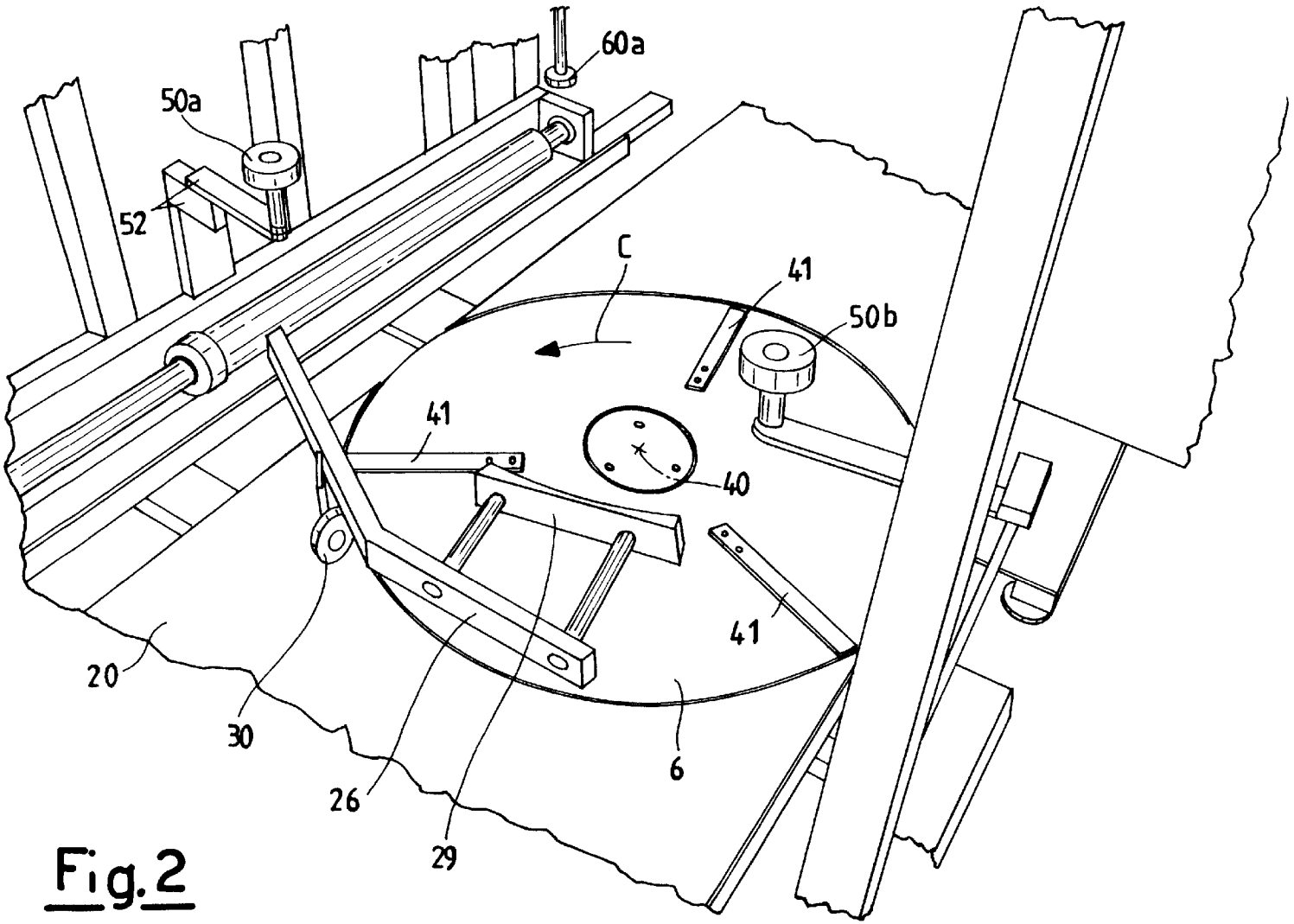
FIG. 2 is a plan view of the service structure.

In order to illustrate more clearly its characteristics and advantages, the present invention is described by way of non-limiting example, with reference to a typical embodiment illustrated in FIGS. 1 to 5.

The plate 6, which is disposed beneath the container 4 during the filling stage, is mounted on a service path platform 20, which is slightly raised from the ground, and contains both an empty container 4' which is waiting, and a full container 4" which is being unloaded. On the other hand the eccentric distributor 5 is mounted on a support and service structure, which consists of pedestals 21 and an upper platform 22, the service units of which are illustrated in greater detail in FIGS. 2 and 3.

The containers are mounted on pivoting wheels 24, in order to facilitate their movement. The three containers are shown respectively with the base level 9' corresponding to the maximum level for 4', i.e. an empty container which is waiting; at the intermediate level 9, i.e. a container 4 which is being filled; and finally at the minimum level 9", i.e. a container 4" which is completely full, to be unloaded and sent to the successive processing operation.

In the available thickness of the eccentric distributor 5 and of the platform 22 on which it is mounted, there are contained the control mechanisms, which, according to systems known in the art, make it possible to obtain high speeds of rotation of the eccentric distributor 5, and a high linear speed of strip deposited in coils in the container. According to these known systems, the strip 7 which is obtained from the pulleys 8 penetrates in the eccentric distributor 5 via a funnel, and from there it is retrieved by a pair of small calenders, from which it emerges rotating, through a hole which is free from roughness, into the top of the container 4 which is being filled. The lower surface of the structure 22 which is presented to the container 4 is substantially flat and smooth; it acts as a top or ceiling for winding of the coils as they are being deposited by means of the distributor 5, since the propensity of the coils to inflate tends to raise them upwards, and to bring them into contact with the said top.

The structure 21/22 is provided with movement units, which thrust the containers between the positions previously described, as well as with precision positioning units, which are illustrated schematically in FIGS. 2 to 5.

The movement units consist substantially of an arm 26, which thrusts the container which is waiting, which in turn thrusts the full container into the successive positions, when the container is changed.

This arm 26 projects from a guide with longitudinal protection 27, is controlled in a known manner, for example by means of a double-effect pneumatic cylinder which is not shown in the figure for the sake of simplicity, with to-and-fro motion, is provided with a container support block 29, and is supported by a support roller 30 on the platform 20.

On the side opposite the longitudinal guide 27, along the path of the containers 4, there is provided a guide bar 33 for the container, with an intake stress raiser. In the platform 20, which constitutes the path of the containers 4, there is provided a circular cavity, in the filling position of the container. In this cavity there is positioned the rotary platform 6, which must accommodate the container 4 which is being filled, which, during the operation of depositing of the strip in coils, must have its axis corresponding exactly with the centre 40 of rotation of the platform 6.

The rotation of the platform is controlled by known means, for example by means of an electric motor and a belt drive, at a speed which is controlled by the machine control unit, and is kept compatible with that of the eccentric distributor 5, such as to deposit, at each rotation of the container 4, a constant number of coils of strip 7 via the distributor 5, and a constant, controlled number of metres of strip.

When the container 4 has been correctly positioned, it is rotated by the platform 6, which rotates constantly in the direction of the arrow C, with the assistance of the radial projections 41, which however do not constitute an obstacle to the movement of the container 4 for translation on its wheels 24, by means of the arm 26, in the operation for the change of containers.

The units for positioning of the container 4 during filling consist of two pairs of centring rollers which can be opened and closed.

Figure 4:
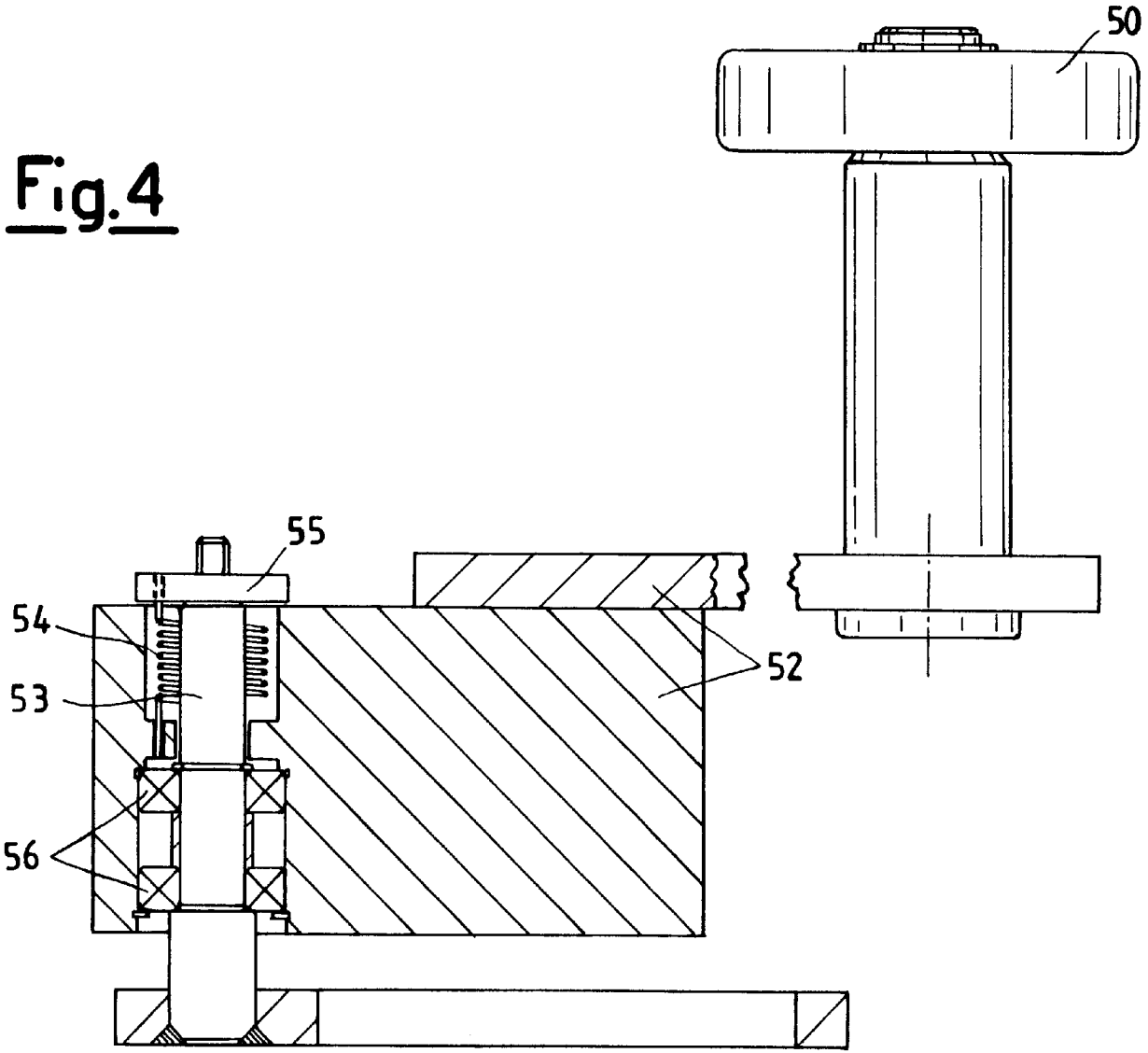
FIG. 4 is a side view of the service structure.

The pair of centring rollers 50*a,b*, which are disposed at the intake of the filling position, are supported by the structure 21/22, by means of the adjustable supports 51*a,b*, which support two mobile levers 52*a,b*, which are hinged at 53*a,b*, according to the detail in FIG. 4.

At the fixed pin 53, there is disposed a pre-loaded coiled spring 54, which is secured at one end to a plate 55, which is integral with the pin 53, and is secured at the other end to the lever 52, which rotates relative to the fixed pin 53 by means of interposition of the bearings 56. The pre-loading of the two springs 54 tends to rotate the levers 52*a,b* towards their aperture through the path of the platform 20, until the levers are supported on a stop 57*a,b*, which acts as an end-of-travel stop. The rollers 50*a,b* are mounted on bearings, such that they do not oppose substantial friction to the rotary motion of the container 4 which is being filled. During movement of the containers, the levers 52*a,b* can be thrust forwards and towards the exterior, according to the arrow D, and as far as the position shown in a broken line, in order to let the new container 4' enter, to replace the full container 4. When this thrust ceases, and the levers are released, the action of the coiled springs 54 prevails, and returns the two levers and their rollers 50*a,b* to the position shown as an unbroken line.

The pairs of centring rollers 60*a,b*, which are disposed at the output of the filling position, are also supported by the structure 21/22, with the supports 61*a,b*, which support two mobile levers 62*a,b*, which are hinged at 63*a,b*. Similarly to the rollers 50*a,b*, the rollers 60*a,b* are also mounted on bearings, in order to limit the friction in the rotary motion of the container 4.

The two levers 62*a,b* can move according to the arrow E, between two positions, which are delimited by end-of-travel stops, which are not shown in the figure, between a closed position which is shown as an unbroken line, and an open position which is shown as a broken line. The movement is carried out by known control means, for movement of extension and retraction between the said positions. For example, the control is provided by two pneumatic, double-effect cylinders 64*a,b*, which are mounted on cross-members of the structure 21/22. These cylinders can have their slider 65*a,b* extended into the position shown as an unbroken line, in order to intercept the path of the container 4, or they can have their slider 65*a,b* retracted into the position shown as a broken line, in order to release the path of the container 4.

Figure 3:
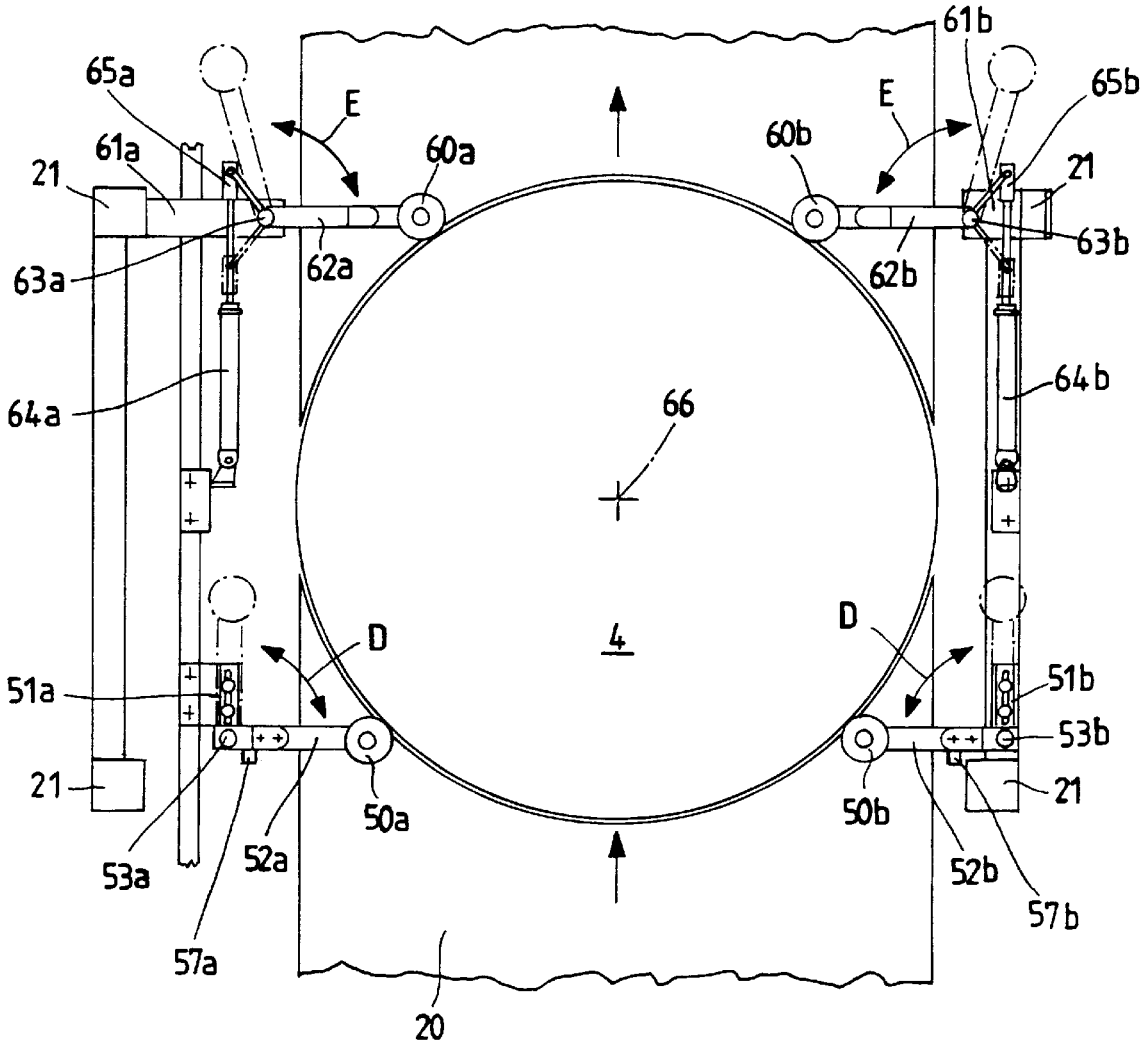
FIG. 3 is a top view of the service structure.

In FIG. 3, the container 4 is shown in the correct filling position, with its axis 66 corresponding to the centre 40 of the platform beneath, owing to the action of the rollers 50 and 60 in contact with its outer surface, which keep it centred in position during the rotation.

Figure 5:
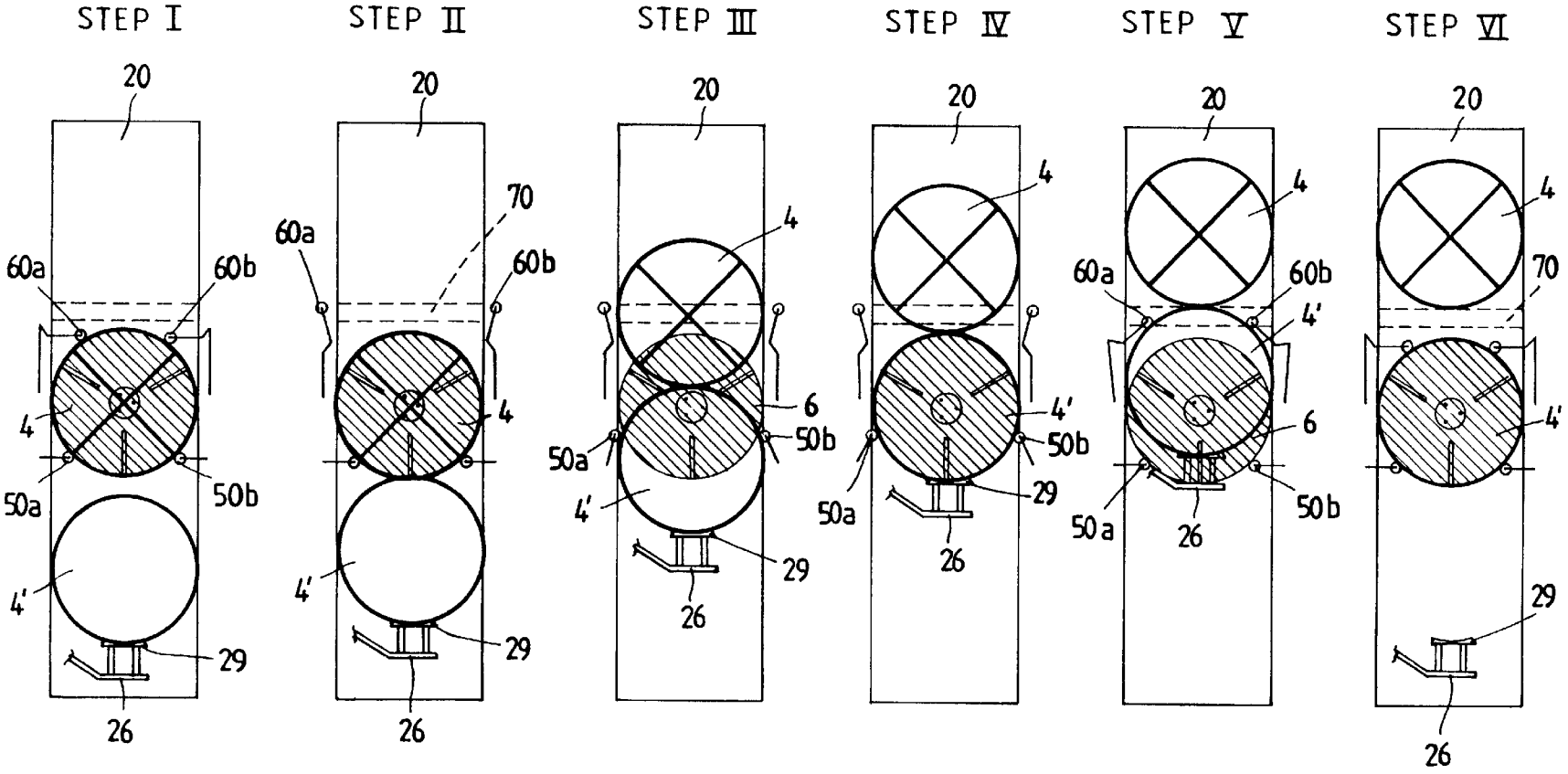
FIG. 5 is a series of top views showing the change and movement of containers.

In order better to explain the movement during the change of containers, the salient steps of the movement are described with reference to FIG. 5. The change of containers can take place with the carder 1 and the collection device 3 functioning at full speed. For the sake of greater clarity, the full container 4 is shown crossed by two diameters.

In position indicated as step I, the container 4 is in the filling position, centred on the rotary platform 6, and rotating together with the latter. The position of the rotary platform is indicated by the area delimited by broken lines. The rotary container 4 receives the strip 7 wound into coils, from the eccentric distributor 5. The centring rollers 50*a,b* and 60*a,b* are adjacent to the cylindrical surface of the container, in order to keep the latter in position. The empty container 4', which is waiting, is in the parked position, spaced from the container which is being filled. When the container 4 is completely full, the container is changed, by unloading the full container 4, and replacing it by the empty container 4' which is waiting. The change of container is normally associated with a system for controlling the length in metres, i.e. the linear quantity of strip deposited. This control can be carried out by means of adding revolution counters, which are disposed on the calenders of the carder unit, or on those which are associated with the distributor 5. These revolution counters are connected to the control unit of the collection unit, in order to determine when the required length in metres has been obtained, for each change of container.

In step II, the centring rollers 60*a,b* on the output side are opened, thus releasing the output path of the platform 20. The arm 26 supports its block 29 on the empty container 4', thrusts the latter against the full container 4, and continues its path forwards. Translation of both containers thus takes place; the empty container 4' is translated but not rotated, whereas the full container 4 is translated and rotated whilst it still receives the strip, until the empty container replaces it beneath the distributor 5.

In step III, the empty container continues to be thrust by the arm 26, and arrives beneath the distributor 5. Whilst the container is in transit, its walls open forwards the levers 52*a,b* of the centring rollers 50*a,b* on the intake side, thus loading the corresponding springs. In this step, depositing of the strip is already beginning into the empty container 4', whilst it is in transit. In general, during the displacement step, the container continues to be translated, but it is not rotated, i.e. it is not yet rotated significantly. In fact, it must be taken into consideration that the pivoting wheels 24 of the replacement container 4', which have already risen onto the rotary platform 6, are already receiving a specific rotational thrust, but both the inertia of the container, and its support on the concave block 29 are braking significantly the rotation which is induced on the replacement container 4', which thus requires a specific amount of time before it rotates synchronously with the platform 6.

In step IV, the empty container 4' continues to be thrust by the arm 26 beyond the filling position, thus reaching the configuration in step V, and therefore releasing the levers 52*a,b* of the centring rollers 50*a,b* on the intake side, which, owing to the effect of the loaded springs 54, return rearwards to the position of interception of the container, and are supported on their end-of-travel stop 55*a,b*. In this position, the constraint by the rollers 50*a,b* prevents the container from reversing beyond the position which is centred relative to the rotary platform 6.

During this travel, the container 4' enters the area which is delimited by the broken lines, which delimit the radius of action of the cutters, which will be described hereinafter. In this step, depositing of the strip continues in the empty container 4', for a total of a few metres, onto the container base 9', which is in the highest raised position. This initial depositing on the base of the container 4' allows the strip to become attached to the base, and to keep satisfactorily taut the section of strip which is in common between the full container 4 to be unloaded, and the empty container 4'which is to replace it.

The arm 26 has now reached its end of travel, and withdraws rearwards, thus releasing the container 4'. In step V, the container 4' is reversed into the filling position. For this purpose, the sliders of the pneumatic cylinders 65*a,b* are extended; the levers 62*a,b* close, thus intercepting once more the output path of the platform 20. The centring rollers 60*a,b* on the output side are supported on the container 4', and thrust it rearwards until it comes into contact with the centring rollers 50*a,b*, in a centred position, in order to make the axis of the container correspond to the centre of rotation of the platform 6.

This final position is shown as step VI, in which the empty container 4' is centred in position on the platform 6. The full container 4 is in the advanced position, and is well spaced. The container 41 is freely rotated by the platform 6, and the normal collection of the strip in the new container 4' continues. The strip 7 is still joining the containers 4 and 41, through the area 70 delimited by the broken lines, which delimit the radius of action of the cutters, which are disposed beneath the platform 22.

The collection unit 3 is provided with a system for controlled cutting of the strip which is common to the two containers 4 and 4', on completion of replacement of the containers, and for control of the resulting end. This is altogether similar to the cutter described in the aforementioned patent application MI95A02123, in the name of the same applicant, and to which reference should be made.

The device according to the invention ensures that the strip 7 which reaches the two containers 4 and 4', and which must be cut, is taut and in a specific position, such that this operation takes place automatically, and more reliably than in the devices according to the known art, in particular without affecting the speed of the carding machine and the collection unit.

When the change of container has been completed, the operators unload the full container 4, and position a new container 4', waiting, to the left of the collection unit 4, thus, if possible, concentrating intervention in the carding section, on movement of full containers 4 and empty containers 4'.

What is claimed is:

1. A method for replacement of a previously filled container with an empty container, comprising the steps of:

providing a filling position for filling containers with a continuous strip;

thrusting the empty container beyond said filling position while pushing the previously filled container with the empty container out of the filling position;

placing the empty container back into the filling position by retracting the empty container back in the filling position; and cutting the continuous strip extended between the previously filled container from said filling position and the empty container.

2. The method of claim 1, further comprising providing a thrusting arm positioned and configured to thrust the empty container.

3. The method of claim 1, further comprising providing a centering device positioned and configured to place the empty container in the filling position.

4. The method of claim 1, further comprising providing a cutter positioned adjacent to the filling position and configured to cut the continuous strip stretched between the previously filled container and the empty container.

5. The method of claim 3, further comprising providing a platform having an axis of rotation, and positioned and configured to receive the empty container and rotate while the empty container is being filled.

6. The method of claim 3, wherein:

the centering device comprises a first pair of levers and a second pair of levers, the first pair of levers positioned at an intake side of the filling position and configured to retract and extend, the second pair of levers positioned at an output side of the filling position and configured to retract and extend;

the thrusting step comprises unloading the previously filled container from the filling position when the second pair of levers are extended and pushing the previously filled container out of the filling position by the empty container; and the placing step comprises retracting the second pair of levers and pushing the empty container back into the center position of the filling position against the first pair of levers by the second pair of levers.

7. The method of claim 1, further comprising providing thrusting means for thrusting the empty container, centering means for placing the empty container in the filling position by retracting the empty container back into the filling position, and cutting means for cutting the continuous strip stretched between the previously filed container and the empty container.

8. An automatic device for packing a continuous strip into an empty container, comprising:

a collection unit including a distributor positioned at a filling position and configured to distribute the continuous strip into the empty container;

a thrusting arm positioned and configured to thrust the empty container beyond the filling position while a previously filled container in the filling position is pushed out of the filling position by the empty container;

a centering device positioned and configured to place the empty container in the filling position by retracting the empty container back into the filling position; and a cutter positioned adjacent to the filling position and configured to cut the continuous strip stretched between the previously filled container and the empty container.

9. The automatic device of claim 8, wherein said thrust arm comprises a concave block to support the empty container being thrust toward the filling position.

10. The automatic device of claim 8, wherein said centering device is attached to said collection unit by a plurality of adjustable supports.

11. The automatic device of claim 8, wherein said distributor is eccentric relative to the empty container and driven by revolution to distribute the continuous strip in the empty container in a form of coils coaxial to the empty container.

12. The automatic device of claim 8, further comprising a rotating device provided in the collection unit and configured to rotate the empty container for collection of the continuous strip, said rotating device including a rotary platform provided at the filling position and configured to receive and rotate the empty container.

13. The automatic device of claim 8, wherein said centering device comprises a first pair of levers and a second pair of levers, said first pair of levers disposed on an intake side of the filling position and configured to make angular rotation and prevent the empty container from moving back beyond a center position of the filling position, said second pair of levers disposed on an output side of the filling position and configured to make angular rotation and retract the empty container back toward the center position of the filling position.

14. The automatic device of claim 13, wherein said first and second pairs of levers comprise at least one centering roller on each lever.

15. The automatic device of claim 13, further comprising control means for controlling the angular rotations of said first and said second pairs of levers, respectively, to control retraction and extension of said first and second pairs of levers, wherein:

the previously filled container is unloaded from the filling position when said second pair of levers are extended and the previously filled container is pushed out the filing position by the empty container; and the second pair of levers retracts said makes the empty container move back into the center position of the filling position.

16. The automatic device of claim 1, further comprising a rotating device provided in the collection unit and configured to rotate the empty container for collection of the continuous strip, said rotating device including a rotary platform provided at the fillng position and configured to receive and rotate the empty container.

17. The automatic device of clam 16, wherein said first pair of levers ensures a center portion of the empty container corresponds with a rotation axis of said rotary platform by contact.

18. An automatic device for packing a continuous strip into an empty container, comprising:

collection means for distributing the continuous strip into the empty container;

thrusting means for thrusting the empty container beyond a filling position while a previously filled container filled with the continuous strip at the filling position is pushed out of the filling position by the empty contaner;

centering means for placing the empty container in the filling position by retracting the empty container back into the filling position; and cutting means for cutting the continuous strip stretched between the previously filled container and the empty container.

19. The automatic device of claim 18, further comprising control means for controlling said centering means to ensure that the empty container is placed in the filling position.

* * * * *